US006098821A

United States Patent [19]

Dubé et al.

[11] Patent Number: 6,098,821

[45] Date of Patent: Aug. 8, 2000

[54] REMOVABLE BOTTOM STANDING DIVIDER UNIT

[75] Inventors: Gilles Dubé; Serge Bisson, both of Saint-Jean-Port-Joli, Canada

[73] Assignee: Rousseau Metal Inc., Quebec, Canada

[21] Appl. No.: 09/161,272

[22] Filed: Sep. 28, 1998

[51] Int. Cl.[7] ..... A47F 5/00

[52] U.S. Cl. ..... 211/184

[58] Field of Search ..... 108/60, 61; 211/184, 211/43, 11

[56] References Cited

U.S. PATENT DOCUMENTS

| | | | |
|---|---|---|---|
| 1,450,191 | 4/1923 | Sturm | 211/184 |
| 2,658,628 | 11/1953 | Hilgen | 211/184 |
| 2,845,188 | 7/1958 | Rosenquist et al. | 211/184 |
| 2,902,166 | 9/1959 | Bahr . | |
| 3,186,668 | 6/1965 | Story . | |
| 3,216,587 | 11/1965 | Anders | 211/184 |
| 3,248,079 | 4/1966 | Kennedy . | |
| 3,269,558 | 8/1966 | Hess . | |
| 3,786,933 | 1/1974 | Vianzon . | |
| 3,872,802 | 3/1975 | Scheerhorn et al. . | |
| 3,954,184 | 5/1976 | Mendenhall | 211/184 |
| 4,120,250 | 10/1978 | Viessmann . | |
| 4,191,299 | 3/1980 | Moore | 211/184 |
| 4,228,906 | 10/1980 | Jones . | |
| 4,349,113 | 9/1982 | Schreiner . | |
| 4,349,171 | 9/1982 | Baldwin . | |
| 4,378,925 | 4/1983 | Griffin . | |
| 4,405,052 | 9/1983 | Spiros . | |
| 4,448,314 | 5/1984 | Weiller | 211/184 |
| 4,560,073 | 12/1985 | King . | |
| 4,618,063 | 10/1986 | Mendenhall | 211/184 |
| 4,684,094 | 8/1987 | Everett . | |
| 4,697,712 | 10/1987 | Valiulis . | |
| 4,712,286 | 12/1987 | Wolf . | |
| 4,733,841 | 3/1988 | Wilson . | |
| 4,753,354 | 6/1988 | Patterson et al. . | |
| 4,759,449 | 7/1988 | Gold | 211/184 |
| 4,852,839 | 8/1989 | Winter et al. . | |
| 4,858,774 | 8/1989 | Winter et al. . | |
| 4,904,110 | 2/1990 | Klein . | |
| 4,942,968 | 7/1990 | Fast | 211/184 |
| 4,971,281 | 11/1990 | Steinbeck . | |
| 5,038,539 | 8/1991 | Kelley et al. . | |
| 5,154,299 | 10/1992 | Hwang . | |
| 5,167,391 | 12/1992 | Simpson . | |
| 5,230,492 | 7/1993 | Zwart et al. . | |
| 5,265,740 | 11/1993 | Hodsden et al. . | |
| 5,287,974 | 2/1994 | Buday . | |
| 5,392,902 | 2/1995 | Vlastakis . | |
| 5,433,327 | 7/1995 | Benvenuti et al. . | |
| 5,472,103 | 12/1995 | Merl . | |
| 5,484,068 | 1/1996 | Huang . | |
| 5,555,990 | 9/1996 | Bechstein | 211/184 |
| 5,695,078 | 12/1997 | Otema . | |
| 5,732,832 | 3/1998 | Kordowski . | |
| 5,839,588 | 11/1998 | Hawkinson | 211/184 |

*Primary Examiner*—Daniel P. Stodola
*Assistant Examiner*—Jennifer E. Novosad
*Attorney, Agent, or Firm*—McDermott, Will & Emery

[57] ABSTRACT

A removable bottom standing divider unit for a shelving system having a shelving wall with a transverse slot. The divider unit has a dividing portion projecting upwardly from a base portion and is self-standing. A tab projects downwardly from the base portion. The tab is shaped to be inserted in the slot in a sliding movement of the divider unit, and has a hooking member to engage the underside of the shelving wall. A locking tooth is provided behind the tab and is also engageable with the slot to oppose against backward motion of the tab in the slot. The divider unit is thereby locked to the shelving wall.

25 Claims, 5 Drawing Sheets

REMOVABLE BOTTOM STANDING DIVIDER UNIT

FIELD OF THE INVENTION

The present invention relates to shelving systems and more particularly to a removable bottom standing divider unit for a shelving wall with one or several transverse slots.

BACKGROUND

It is well known to provide file cabinets or storing shelves with divider units to facilitate the keeping and proper arrangement of documents or articles of all types.

Known in the art is, for example, U.S. Pat. No. 4,560,073 (KING) showing a rack provided with a plurality of dividers. The dividers are mounted onto a special and unconventional rail system on the base member of the rack.

U.S. Pat. No. 3,269,558 (HESS) discloses a compartmented shelf provided with divider units having bottom tabs inserted into corresponding slots in the base panel of the shelf. To hold the divider units in an upright position, the shelf can be provided with an elongated locking member which is secured either to the base panel of the shelf to provide lateral restraining support for the tabs projecting under the base panel, or to the rear panel at the back for the shelf to provide backside support of the dividers.

As another example, U.S. Pat. No. 5,732,832 (KORDOWSKI) discloses a divider unit that may be fixed on a shelf by means of three aligned bottom tabs insertable into corresponding slots in the base panel of the shelf. Another tab is provided on the rear uppermost part of the divider, and is for insertion into a special retaining rail extending on the rear panel of the shelf. The divider unit is locked in place by a pin inserted in one of the bottom tabs.

Also known in the art are the following U.S. patents, which generally relate to filing systems: U.S. Pat. Nos. 2,902,166; 3,186,668; 3,248,079; 3,786,933; 3,872,802; 4,120,250; 4,228,906; 4,349,113; 4,349,171; 4,378,925; 4,405,052; 4,684,094; 4,697,712; 4,712,286; 4,733,841; 4,753,354; 4,852,839; 4,858,774; 4,904,110; 4,971,281; 5,038,539; 5,154,299; 5,167,391; 5,230,492; 5,265,740; 5,287,974; 5,392,902; 5,433,327; 5,472,103; 5,484,068; and 5,695,078.

SUMMARY OF THE INVENTION

One object of the present invention is to provide a divider unit for a shelving wall which is of simple yet highly effective construction to stand in a stable dividing position and in place once installed.

Another object of the present invention is to provide such a divider unit which is bottom-only attached and locked to the shelving wall.

A further object of the invention is to provide such a divider unit which is compatible with some already existing shelving wall models.

In accordance with the present invention, there is provided a removable bottom standing divider unit for a shelving wall with a transverse slot. The divider unit has a base portion having a bottom surface shaped to rest on the shelving wall, and a dividing portion projecting upwardly from the base portion. A tab projecting downwardly from the base portion is shaped for slidable insertion into the slot and has a forwardly extending hooking member spaced from the bottom surface of the base portion for underside engagement with the shelving wall upon insertion of the tab in the slot.

A locking tooth projects downwardly from the base portion behind the tab at a distance therefrom so that the tooth engages in the slot and opposes against backward motion of the tab in the slot when the hooking member is in underside engagement with the shelving wall, thereby locking the divider unit on the shelving wall.

BRIEF DESCRIPTION OF THE DRAWINGS

A detailed description of preferred embodiments of the invention will be given herein below with reference to the following drawings, in which like numbers refer to like elements.

DESCRIPTION OF A PREFERRED EMBODIMENT OF THE INVENTION

Figure 1:
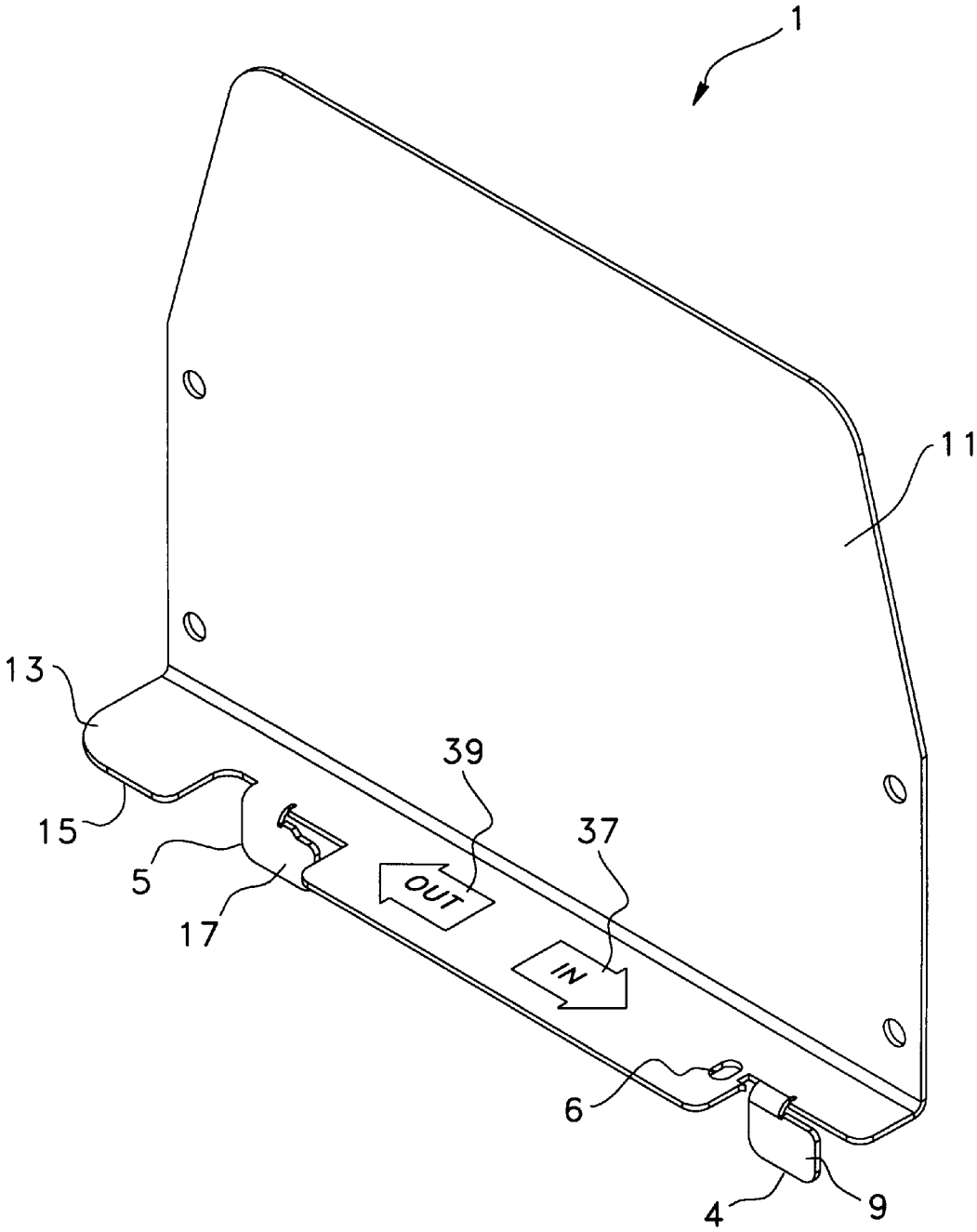
FIG. 1 is a perspective view of a divider unit according to a preferred embodiment of the present invention.
Figure 2:
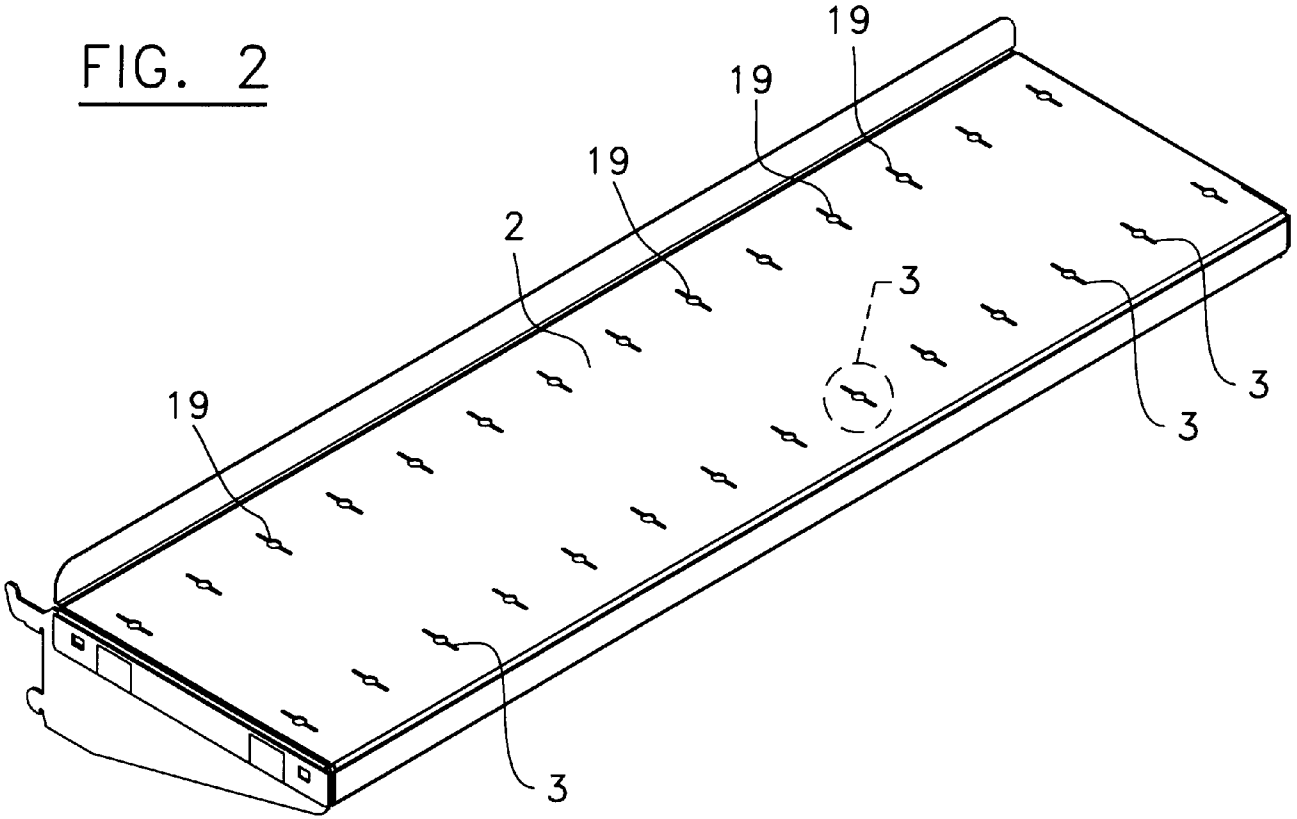
FIG. 2 is a perspective view of a shelving wall adapted to receive the divider unit as shown in FIG. 1.

With reference to FIGS. 1 and 2, there is respectively shown a bottom standing divider unit 1 and a shelving wall 2 with a transverse slot 3, both according to a preferred embodiment of the invention.

The divider unit 1 has two main parts: a base portion 13 having a bottom surface 15 shaped to rest on the shelving wall 2, and a dividing portion 11 projecting upwardly from the base portion 13. In the preferred embodiment shown, the dividing portion 11 is integral with the base portion 13 and is at a right angle therewith, the two portions 11 and 13 forming an L-shaped figure as may be seen on FIG. 1. The divider unit 1 is provided with a tab, projecting downwardly from the base portion 13. The tab 4 is shaped for slidable insertion into the slot 3 and has a forwardly extending hooking member 9. The hooking member 9 is spaced from the bottom surface 15 of the base portion 13. In this manner, when the tab 4 has been inserted into the slot 3, the hooking member 9 engages the underside of the shelving wall 2. To efficiently lock the engagement of the divider unit 1 with the shelving wall 2, the divider unit 1 is further provided with a locking tooth 6, also projecting downwardly from the base portion 13. The locking tooth 6 is positioned behind the tab 4, at a distance therefrom, so that the tooth 6 engages in the slot 3 and opposes against a backward motion of the tab 4 in the slot 6 when the hooking member 9 is in underside engagement with the shelving wall 2. The divider unit 1 is thereby locked in place on the shelving wall 2.

In the preferred embodiment shown in FIG. 1, the divider unit 1 has an additional tab 5, also projecting downwardly from the base portion 13 and spaced apart from the other tab 4. Both tabs 4 and 5 may be integral with the base portion 13. The additional tab 5 may have substantially the same shape as the first tab 4, and is also provided with a hooking member 17 spaced from the bottom surface 15 of the base portion 13 for underside engagement with the shelving wall 2. Accordingly, the shelving wall 2 is provided with an additional slot 19 spaced apart from the first slot 3 and aligned therewith. The additional tab 5 is slidably insertable in the additional slot 19 for a better engagement of the divider unit 1 with the shelving wall 2. Preferably, the shelving wall has a plurality of pairs of aligned slots 3 and 19, each pair of slots providing a possible position for a divider unit 1.

Figure 3:
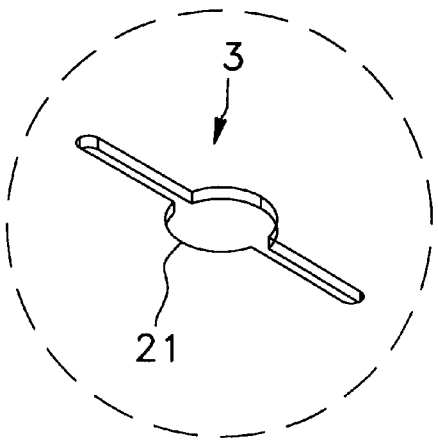
FIG. 3 is an enlarged view of section 3 of FIG. 2.

With reference to FIGS. 2 and 3, each slot 3 or 19 preferably has a widening 21 forming an oblong-shaped hole to receive the locking tooth 9. Giving such a shape to both slots 3 and 19 of a pair of aligned slots has the advantage of allowing the engagement of the divider unit 1 with the shelving wall in two possible directions, since either slot may receive the tooth 6.

Figure 4:
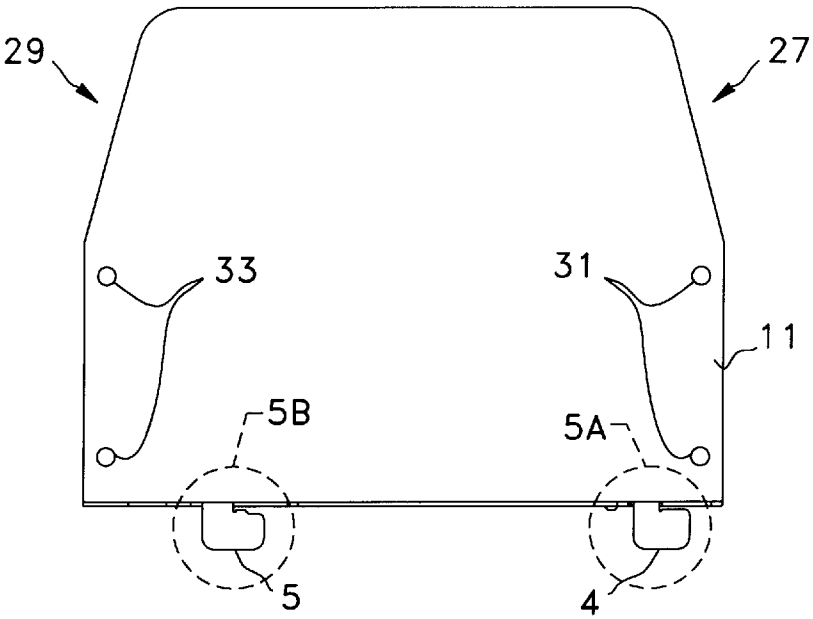
FIG. 4 is an side elevation view of the divider unit of FIG. 1.
Figure 5A:
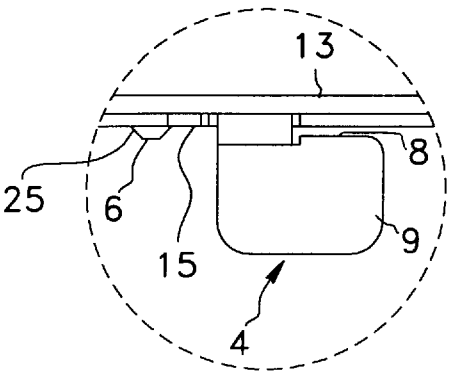
FIG. 5A is an enlarged view of section 5A of FIG. 4.
Figure 5B:
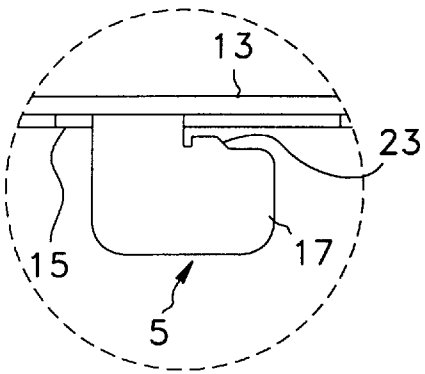
FIG. 5B is an enlarged view of section 5B of FIG. 4.

With reference to FIGS. 4, 5A and 5B, preferred characteristics of the divider unit 1 are further illustrated.

As shown in FIG. 4, the dividing portion 11 preferably has a generally flat rectangular shape with bevelled upper edges 27, 29, and has front and rear pairs of spaced apart transverse holes 31, 33.

FIGS. 5A and 5B show respectively the first tab 4 and the additional tab 5. The tab 4 is preferably provided with a protrusion 8 projecting towards the base portion 13. The protrusion 8 provides better engagement of the hooking member 9 with the underside of the shelving wall 2. Similarly, the additional tab 5 may also be provided with a protrusion 23. In this case, it may be advantageous for the protrusion 23 to extend only partially over the upper surface of the hooking member 17 and to be located rearwards over the hooking member 17 to avoid hampering the insertion of the tab 5 in the slot 19.

FIG. 5A also illustrates the preferred shape of the locking tooth 6. In the present embodiment, the tooth 6 has a rearward ascending rear surface 25 that facilitates disengagement of the tooth 6 from the slot 3 upon a forced rearward sliding motion of the divider unit 1 on the shelving wall 2.

Figure 6A:
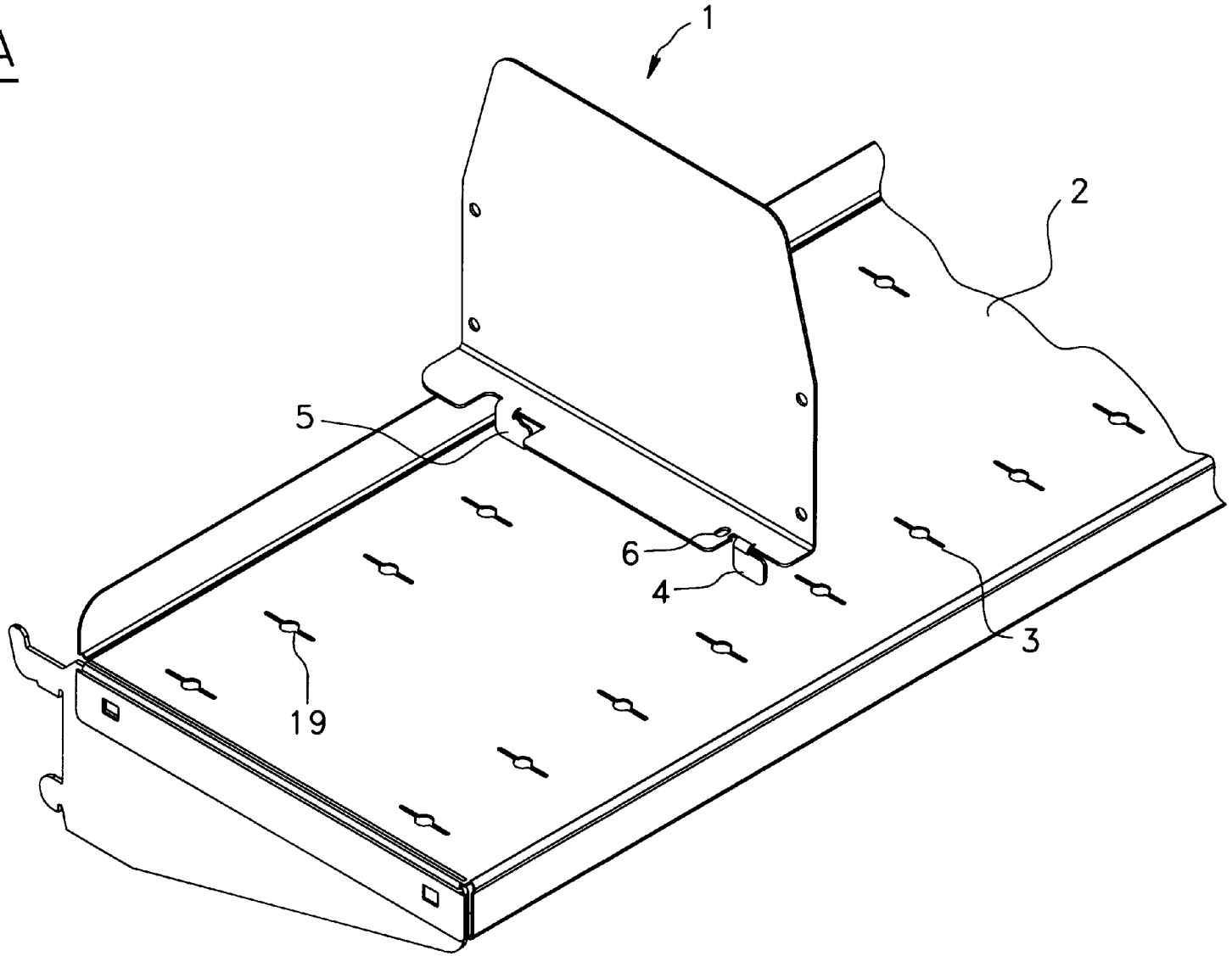
FIG. 6A is a perspective view of a divider unit over a shelving wall according to the present invention.
Figure 6B:
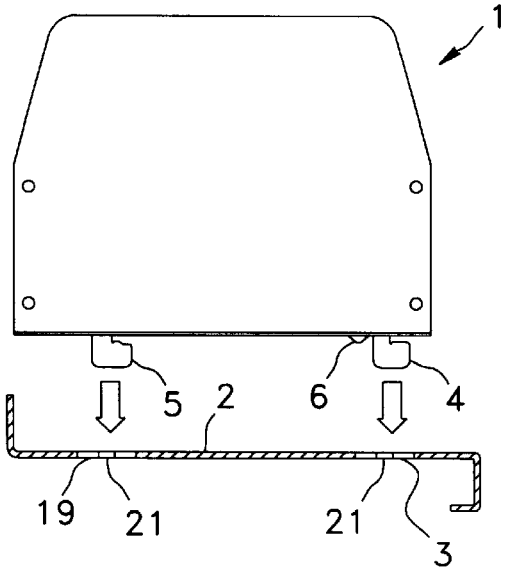
FIG. 6B is a side view of the divider unit of FIG. 6A, aligned with the shelving wall for engagement therewith.
Figure 6C:
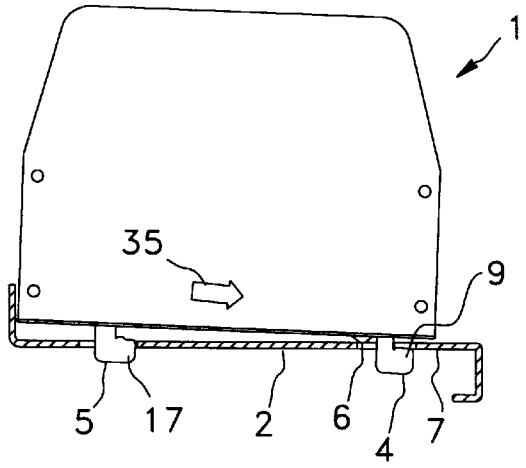
FIG. 6C is a side view of the divider unit of FIG. 6A, being slidably engaged with the shelving wall.
Figure 6D:
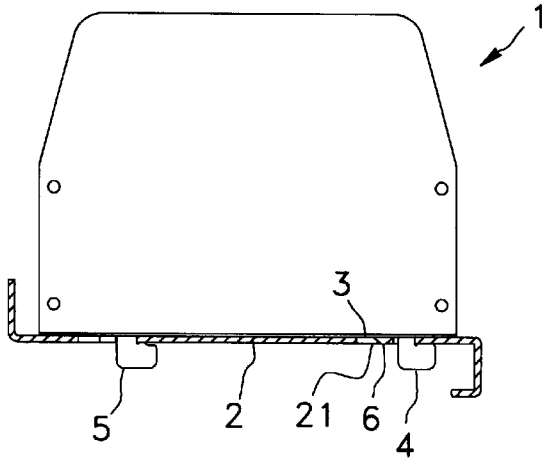
FIG. 6D is a side view of the divider unit of FIG. 6A, engaged with the shelving wall.

With reference to FIGS. 6A to 6D, the preferred manner in which a divider unit 1 according to the invention is engaged with the shelving wall 2 is illustrated. As shown in FIG. 6A, the divider unit may be positioned over any desired pair of aligned slots 3 and 19. The divider unit 1 is first placed over a chosen pair of slots 3 and 19, with the tabs 4 and 5 respectively aligned with the slots 3 and 19 as shown in FIG. 6B. As explained above, in the present embodiment, since the slot 19 has a widening 21, it is also possible to align the tab 4 with the slot 19 and the tab 5 with the slot 3, reversing the rearward and forward directions of the divider unit 1. As shown in FIG. 6C, the tabs 4 and 5 are then inserted in the corresponding slots 3 and 19 and the divider unit 1 is slid in the forward direction as depicted by the arrow 35, causing the hooking portions 9 and 17 to underside engage with the shelving wall 2. The divider unit 1 is finally locked in place when the locking tooth 6 gets engaged in the widening 21 of the slot 3, as shown in FIG. 6D. To disengage the divider unit 1 from the shelving wall 2, it is necessary to push the divider unit 1 in the rearward direction with enough force to disengage the tooth 6 from the widening 21.

Referring back to FIG. 1, the divider unit 1 may be provided with pictograms 37, 39 depicting engagement and disengagement directions of the divider unit 1, in the present case arrows labelled "IN" and "OUT" on the top surface of the base portion 13.

In the preferred embodiment, the base portion 13, the dividing portion 11 and the tabs 4 and 5 are all punched out of a single sheet of metal. Of course, any appropriate material and manufacturing method could also be used. The locking tooth 6 may also be punched directly in the base portion 13.

One or several shelving walls like the shelving wall 3 shown in FIG. 2 and a plurality of divider units 1 as described above can be used to provide a shelving system. The shelving wall 3 may be provided by a drawer shelf in the case of a cabinet or any surface suitable for receiving documents or articles like tools in the case of a workbench. The shelving system may comprise as many shelving walls and divider units as desired.

The advantages of the present invention are numerous. The combination of a bottom portion and a dividing portion allows the divider to be self standing and eliminates the need for means to attach it to a back panel or other holding means as often required in the prior art dividers. The addition of a locking tooth in proximity to one of the tabs is a simple and effective manner to lock the divider unit in place on the shelving wall. No tool is needed to install or remove the divider unit.

Of course, numerous modifications could be made to the preferred embodiments disclosed hereinabove without departing from the scope of the invention as defined in the appended claims.

What is claimed is:

1. A removable bottom standing divider unit for a shelving wall having a transverse slot, comprising:

a base portion having a bottom surface adapted to rest on the shelving wall;

a dividing portion projecting upwardly from the base portion;

a tab projecting downwardly from the base portion, the tab being adapted for slidable insertion into the slot and having a forwardly extending hooking member spaced from the bottom surface of the base portion adapted to engage an underside of the shelving wall; and a locking tooth projecting downwardly from the base portion behind the tab at a distance therefrom, the locking tooth being adapted to lock the divider unit on the shelving unit by engaging the slot and preventing backward motion of the tab in the slot when the hooking member engages an underside of the shelving wall, wherein an entirety of both the tab and the locking tooth project downwardly from the base portion, and wherein the locking tooth has a sloping surface that slopes through the slot substantially to the base portion.

2. The divider unit according to claim 1, further comprising an additional tab projecting downwardly from the base portion and spaced apart from the tab, the additional tab being adapted for slidable insertion into an additional slot of the shelving wall and having a forwardly extending hooking member spaced from the bottom surface of the base portion adapted to engage an underside of the shelving wall when inserted in the additional slot.

3. The divider unit according to claim 2, wherein the hooking member of the additional tab has an upper surface provided with a protrusion projecting towards the base portion.

4. The divider unit according to claim 2, wherein:

the dividing portion is integral with the base portion and is at a right angle therewith, the base portion and the dividing portion forming an L-shaped figure;

the dividing portion has a generally flat rectangular shape with bevelled upper edges;

the hooking members of the tab and the additional tab each have an upper surface provided with a protrusion projecting towards the base portion;

the tooth is punched in the base portion and has a rearward ascending surface adapted to facilitate disengagement of the tooth from the slot upon a forced rearward sliding motion of the divider unit; and the base portion, the dividing portion, the tab and the additional tab are punched out of a single sheet of metal.

5. The divider unit according to claim 1, wherein the dividing portion is integral with the base portion.

6. The divider unit according to claim 1, wherein the dividing portion is at a right angle with the base portion.

7. The divider unit according to claim 1, wherein the base portion and the dividing portion form an L-shaped figure.

8. The divider unit according to claim 1, wherein the dividing portion has a generally flat rectangular shape with bevelled upper edges.

9. The divider unit according to claim 1, wherein the tab is integral with the base portion.

10. The divider unit according to claim 1, wherein the hooking member has an upper surface provided with a protrusion projecting towards the base portion.

11. The divider unit according to claim 1, wherein the sloping surface of the locking tooth is adapted to facilitate disengagement of the tooth from the slot upon a forced rearward motion of the divider unit on the shelving wall.

12. The divider unit according to claim 1, wherein the locking tooth is punched in the base portion.

13. The divider unit according to claim 1, wherein the base portion, the dividing portion and the tab are punched out of a single sheet of material.

14. The divider unit according to claim 1, wherein the base portion, the dividing portion and the tab are made of metal.

15. The divider unit according to claim 1, wherein the base portion has a top surface provided with pictograms depicting engagement and disengagement sliding directions.

16. The divider unit according to claim 1, wherein the dividing portion has front and rear pairs of spaced apart transverse holes.

17. A shelving system comprising:

a shelving wall with a plurality of longitudinally spaced apart transverse slots; and a plurality of divider units, each comprising:

a base portion having a bottom surface adapted to rest on the shelving wall;

a dividing portion protecting upwardly from the base portion;

a tab projecting downwardly from the base portion, the tab being adapted for slidable insertion into the slot and having a forwardly extending hooking member spaced from the bottom surface of the base portion adapted to engage an underside of the shelving wall; and a locking tooth projecting downwardly from the base portion behind the tab at a distance therefrom, the locking tooth being adapted to lock the divider unit on the shelving unit by engaging the slot and preventing backward motion of the tab in the slot when the hooking member engages an underside of the shelving wall, wherein an entirety of both the tab and the locking tooth project downwardly from the base portion, and wherein the locking tooth has a sloping surface that slopes through the slot substantially to the base portion.

18. A shelving system comprising:

a shelving wall having a plurality of pairs of aligned spaced apart slots; and a removable divider unit having:

a base portion having a bottom surface formed to rest on the shelving wall;

a dividing portion projecting upwardly from the base portion;

a tab projecting downwardly from the base portion, the tab being slidably insertable into one of each pair of slots of the shelving wall and having a forwardly extending hooking member spaced from the bottom surface of the base portion that engages an underside of the shelving wall when the tab is inserted into the one of each pair of slots of the shelving wall;

a locking tooth projecting downwardly from the base portion behind the tab at a distance therefrom so that the tooth engages in the one of each pair of slots of the shelving wall and prevents the tab from moving backward in the one of each pair of slots of the shelving member when the hooking member engages an underside of the shelving wall to thereby lock the divider unit on the shelving wall, wherein an entirety of both the tab and the locking tooth project downwardly from the base portion, and wherein the locking tooth has a sloping surface that slopes through the slot substantially to the base portion; and an additional tab projecting downwardly from the base portion and spaced apart from the tab, the additional tab being slidably insertable into another one of each pair of slots of the shelving wall and having a forwardly extending hooking member spaced from the bottom surface of the base portion that engages an underside of the shelving wall when inserted in the other one of each pair of slots of the shelving wall.

19. The divider unit according to claim 18, wherein each slot has a widening portion forming an oblong-shaped hole to receive the locking tooth.

20. The system according to claim 18, wherein the dividing portion and the base portion are formed as a single piece and form a right angle.

21. The system according to claim 18, wherein the dividing portion has a substantially flat rectangular shape with bevelled upper edges.

22. The system according to claim 18, wherein the hooking member of the tab and the hooking member of the additional tab each have an upper surface with a protrusion projecting towards the base portion.

23. The system according to claim 18, wherein the sloping surface of the locking tooth facilitates disengagement of the tooth from the one of each pair of slots upon a forced rearward motion of the divider unit on the shelving wall.

24. The system according to claim 18, wherein the dividing unit further includes front and rear pairs of spaced apart transverse holes.

25. The system according to claim 18, wherein:

the dividing portion is integral with the base portion and is at a right angle therewith, the base portion and the dividing portion forming an L-shaped figure;

the dividing portion has a generally flat rectangular shape with bevelled upper edges;

the hooking members of the tab and the additional tab each have an upper surface provided with a protrusion projecting towards the base portion;

the locking tooth is punched in the base portion and has a rearward ascending surface that facilitates disengagement of the tooth from the one of each pair of slots upon a forced rearward sliding motion of the divider unit on the shelving wall, the one of each pair of slots each having a widening portion forming an oblong-shaped hole to receive the locking tooth; and the base portion, the dividing portion, the tab and the additional tab are punched out of a single sheet of metal.

* * * * *